US005535888A

United States Patent [19]

De Luca

[11] Patent Number: 5,535,888

[45] Date of Patent: Jul. 16, 1996

[54] THERMAL INSULATING AND CUSHIONING PACKAGE AND METHOD OF MAKING THE SAME

[75] Inventor: Nicholas P. De Luca, Jamaica Plain, Mass.

[73] Assignee: Novus Packaging Corporation, Watertown, Mass.

[21] Appl. No.: 344,109

[22] Filed: Nov. 23, 1994

[51] Int. Cl.[6] ..... B65D 81/02; B65D 85/30

[52] U.S. Cl. ..... 206/522; 206/521; 206/591

[58] Field of Search ..... 206/521, 522, 206/523, 524, 591

[56] References Cited

U.S. PATENT DOCUMENTS

| | | | |
|---|---|---|---|
| 3,306,513 | 2/1967 | Fishman | 206/521 |
| 3,412,521 | 11/1968 | Bauman | 206/523 X |
| 3,769,145 | 10/1973 | Gresham et al. | 206/521 X |
| 4,193,499 | 3/1980 | Lookholder | 206/524 |
| 4,793,123 | 12/1988 | Pharo | 206/522 X |
| 4,872,558 | 10/1989 | Pharo | 206/522 |
| 4,874,093 | 10/1989 | Pharo | 206/522 |
| 4,934,534 | 6/1990 | Wagner | 206/523 X |
| 5,009,318 | 4/1991 | Lepinoy | 206/522 X |
| 5,263,587 | 11/1993 | Elkin et al. | 206/522 |
| 5,402,892 | 4/1995 | Jaszai | 206/522 |

*Primary Examiner*—Paul T. Sewell
*Assistant Examiner*—Tara L. Laster
*Attorney, Agent, or Firm*—Rines and Rines

[57] ABSTRACT

A thermally insulating and cushioning inflatable and deflatable packaging for shipping or storing items, such as cold articles and the like, formed of thin film valve-inflatable chambers or envelopes preferably of high emissivity and low absorptivity coefficients material and provided with interior inflating-expandable honeycomb-like or cellular baffles adhered in collapsed or closed position to the interior walls of the inflatable chambers; and novel methods of making the same, including incorporating, outer shipping envelopes or bags.

13 Claims, 6 Drawing Sheets

610
612
611
609
607
615
608
613
606
614
604
605
617
603
613
616
700
601
602
621
618
651
702
620
619
701

THERMAL INSULATING AND CUSHIONING PACKAGE AND METHOD OF MAKING THE SAME

The present invention relates to inflatable envelope containers or packages for use as thermally insulating protective cushioning devices for transport of articles that are to be maintained at or near their temperature at the time of packaging; for example, cold articles that are to be shipped and maintained at or near their initial packing temperature.

BACKGROUND OF THE INVENTION

The use of thermal insulative packaging for the shipment of frozen or refrigerated items has broad applications in present-day commerce. Applications throughout the food, biomedical, clinical sampling, and industrial manufacturing markets require the use of an insulated transport device to keep samples cold for extended periods of time. Maintaining cold temperatures, while shipping products, has been done using three basic methodologies: 1) employing a powered refrigeration unit, 2) through contact with cold material such as ice or solid carbon dioxide (dry ice), or 3) using the "coldness" of the product itself. While a refrigeration unit permits storage times of years, storage times using ice or dry-ice is commonly less than a week, and storage times of less than a day can be expected when employing the "coldness" of the product itself.

On a broad scale, the cost of using each methodology is proportional to its storage time capability. In addition, selection of a methodology for storing an item is also dependent on the quantity or number of items being shipped. While a refrigeration unit is more appropriate for bulk shipments over long distances, use of a cold pack is more appropriate for an overnight shipment of a single product.

The efficiency and efficacy of each storage method is most affected by the insulative characteristics of the container itself, or, in other words, the barrier that each container presents to external heating elements. Heating of a product occurs in three ways: conduction, convection, and through radiation. The successful insulation of a cold product inside a container is solely dependent on the ability of the container to inhibit these three heating factors. In general, when designing the container so as to meet the insulative standards desired, it is necessary to understand how each heating element can most effectively be countered.

In understanding the underlying problems, it is useful to consider the effects of each of heat conduction, convection, and radiation.

Conduction

Conduction occurs as heat, in the form of molecular vibration, passing from molecule to molecule through a material. The conductive heat flow, $Q_c$, through a material of thermal conductivity, k, area, A, and temperature gradient across the material, $\Delta T$ is:

$$Q_c=(k)(A)(\Delta T) \qquad \text{Eq. 1}$$

Typical k values, in units of Btu/(h·ft$^2$·°F·ft), for various substances are given below:

TABLE 1

| Substance | Temperature (°F.) | Value |
|---|---|---|
| Air | 32 | 0.0140 |
| Aluminum | 70–700 | 130 |

TABLE 1-continued

| Substance | Temperature (°F.) | Value |
|---|---|---|
| Argon | 32 | 0.00915 |
| Carbon Dioxide | 32 | 0.0084 |
| Gold | 60–212 | 196 |
| Polystyrene | 32 | 0.021 |
| Silver | 70–600 | 242 |
| Sulfur Dioxide | 32 | 0.005 |
| Water | 32 | 0343 |

In choosing container design parameters so as to minimize the heat conduction through the container and therefore maximize insulation (regardless of temperature difference between the environment and the inside of the container), one would clearly choose to use a material with a minimum k factor (such as sulfur dioxide), with infinite wall thickness, and of spherical form (where A is smallest for the internal volume). In practical terms, though, one must consider material costs, shipping costs, and structural integrity when designing the container. To date, the most common container for shipping chilled items using ice or dry-ice is a hollow expanded polystyrene (k=0.02) box of wall thickness commonly ranging from 1 to 3 inches.

Convection

Convective heat transfer occurs between two surfaces at different temperatures that are separated by a free-flowing fluid or gas. As an example, consider placing a pot filled with water atop an electric stove. As a unit of water is heated at the bottom surface of the pot, its density diminishes with respect to the surrounding water, and it therefore rises to the top of the pot, touching the cold surface of the pot cover. Upon touching the cover, the unit of water transfers its heat to the pot cover, thus cooling down, increasing in density with respect to the surrounding water, and further sinking back to the bottom of the pot. This cycling creates convective heat currents between the hot bottom and cold top of the pot.

In regard to keeping items cold (or warm) within an insulative box one must minimize the convective heat transfer that occurs between the cold product and the environment. The Grashof criterion is used to determine whether convective heat transfer will occur between walls at different temperatures filled in-between with a given filler medium. For blocking convective heat transfer between given walls of the container, the Grashof criterion must be less than one thousand.

$$\text{Grashof}=\frac{2gl^3(T_2-T_1)}{v^2(T_1+T_2+546)}<1000 \qquad \text{Eq. 2}$$

Where:

g=gravitational constant (m/sec$^2$)

l=distance between walls (m)

v=viscosity of fluid between walls (m$^2$/sec)

$T_1$=temperature of insulated objet (°C.)

$T_2$=ambient temperature (°C.)

Using Grashofs criterion, one can determine the minimum distance between walls, 1, for which convective heat transfer will not occur. Using air, an ambient temperature of 30° C., and an interior sample temperature of −10° C., a minimum spacing of 0.495 centimeters between air gaps in an air-filled wall are necessary to prevent convective cooling. An expanded polystyrene or similar material box has walls that are made of closed cells containing air. The box acts as an effective barrier to thermal convective heating since the diameter of each cell measures far less than Grashof's threshold value of 0.495 centimeters. The primary problem with using a polystyrene box as an insulator, however, lies in its inherent bulk and lack of collapsibility during storage. Secondary environmental problems in using polystyrene involve the current lack of a diffuse recycling program for the material as compared to recycling programs for low and high density polyethylene.

The use of honeycomb or cellular structures inside walls is also widely discussed in the prior art. These structures are intended to be permanently affixed on the inner space between an exterior wall of a sheltered structure (such as a home or building) and the interior wall of the structure. Among prior art proposals are those of U.S. Pat. Nos. 3,314,846; 3,547,751; 4,673,600; 4,865,889; 5,062,751; 5,171,114; and U.S. Pat. No. Re. 26,444. Although such structural approaches could be adopted for minimizing convective heating of a cold sample during shipment, the cost of creating a container that incorporates the baffles is, to date, inherently prohibitively expensive.

In addition, many of these baffled structures are commonly made of paperboard material, which must be treated to avoid disintegration from contact with moisture commonly forming near a cold object through condensation of water from air. U.S. Pat. No. 2,703,770 describes a honeycomb structure created using plastic material and alternating heat sealing dots. The process for the use of such an approach, however, is extremely slow as the rate of the machine is limited by the inherent time required for heat sealing the dots. While increased rates may be achieved through multiple heat sealing fixtures, such prove expensive and difficult to assure proper quality control.

Radiation

Radiative heating of a body is most commonly observed as infrared radiation from the sun striking an object and, depending on the emissivity and absorptivity of the object, raising its temperature. Radiation is emitted not only from burning stars, but from all surfaces; the level and spectrum of the radiation being solely dependent on the temperature of the surface.

In considering a body which absorbs all incident external radiation and emits radiation solely as a function of its absolute temperature T, also called a blackbody source (with emissivity $\epsilon=1$), the radiative heat $Q_R$ from the body is given by the Stefan-Boltzmann law:

$$Q_R=\epsilon\sigma T^4 \qquad \text{Eq. 3}$$

Where:

$$\sigma=\textit{Stefan-Boltzman constant}=5.67\times10^{-8}\ W/m^2(K)^4$$

In considering an object or package of area $A_1$ at absolute temperature $T_1$ surrounded by a blackbody at absolute temperature $T_2$ with emissivity, $\epsilon_2=1$, as may be characterized by the surrounding walls of a room or a closed truck, the radiant heat exchange between the object and the surroundings is given by the following:

$$Q_{1-2}A_1\sigma(\epsilon_1T_1^4-\alpha_1\epsilon_2T_2^4) \qquad \text{Eq. 4}$$

Where:

$\epsilon_1$=Emissivity of the object $\alpha_1$=Absorptivity of the object

While the difference in temperature between object and surroundings affects heat transfer from conduction and convection in Eqs. 1 and 2 in a linear mode, radiative heat transfer changes with the 4th power of temperature difference in Eq. 4. For this reason, the radiative heat transfer properties of a package must be carefully studied as well as the ambient temperatures in which the package will be exposed.

In designing a package most effectively to block thermal heating from the environment, for example for shipment of frozen products, it is desirable to use a material with a low coefficient of absorptivity and a high coefficient of emissivity.

As before stated, for the purposes of the invention, the thermal insulation must also provide appropriate cushioning protective packaging properties.

Cushioning

The benefits of inflatable packaging are largely discussed in my co-pending application Ser. No. 092,750, filed Jul. 16, 1993 for Inflatable Flat Bag Cushioning and Method of Operating and Making The Same, in which there is disclosed an improved adjacent T-chamber, balloon or thin film flexible envelope packaging system, inflatable, for example, by injecting air simultaneously into the envelope chambers through a single inflation inlet. The inlet is provided with a self-sealing flutter valving mechanism, such as that described in my further co-pending application Ser. No. 278,610 filed on Jul. 21, 1994 for Flutter Valve Assembly For Inflatable Packaging And The Like, enabling independent chamber filling and sealing; and such also being also deflatable to permit reuse of the envelopes.

Such inflatable packaging structures and the like, provide adequate cushioning for fragile articles by using large pockets of compressible medium, such as air, to surround the object. In the case of using a medium such as air, it is necessary that these pockets be large so as to provide the needed cushioning characteristics. Unfortunately, though, as is discussed in the convection section above, these pockets also provide excellent regions for convective currents to form that bring the interior object to the ambient temperature.

OBJECTS OF INVENTION

A primary object of the present invention, therefore, is to provide a new packaging container and method of making the same that most effectively protects particularly a cold item from all of conductive, convective, and radiative heating from the environment during transport, while simultaneously incorporating the benefits of inflatable packaging system to provide cushioning or shock protection for the item.

It is also an object of this invention to provide such a thermal protective container that achieves protection from convective heating through the use of collapsible baffles; such baffles, moreover, being designed to enable using an in-line forming process that is relatively fast compared to current manufacturing techniques of plastic baffled structures and the like.

A further object is to provide such a novel thermal protective container that is made from a material with a low coefficient of absorption and high coefficient of emissivity and is useful both for cold and other temperature-maintained articles.

Another objective is to provide a thermal protective container that is made with a low thermal conductivity k factor, such as air, carbon dioxide, or argon or the like, and simultaneously provides a rigid structure for protective shipment of articles.

It is also an object of this invention to provide a thermal protective container that is made with a material that is widely recycled such as paper, glass, aluminum, steel, and low and high density polyethylene or the like.

Other and further objects will be explained hereinafter and are more particularly pointed out in connection with the appended claims.

SUMMARY

In summary, the invention embodies a package for retaining cold articles having, in combination, a pair of adjacent cushioning envelopes inflatable through an externally extending valve; and collapsed planar honeycomb-like strips internally adhered within one or both of the inflatable cushioning envelopes and inflatable with the envelopes to form open cellular baffles between the inner walls of the cushioning chambers that prevent heat convection therein and minimize heat conduction there between; the pair of inflatable envelopes receiving and cushioning a cold article there between.

The invention employs an inflatable protective package such as described in said copending application U.S. Pat. Ser. No. 092,750 with valve means as described therein and in co-pending application U.S. Pat. Ser. No. 278,610, in conjunction, in accordance with the present invention, with novel inflatable expanding baffles adhered to the interior walls of the inflation chambers. Such package may be inserted within an external or outer shipping envelope, bag, or box. The package and outer shipping envelope, bag, or box made preferably with a singular type of material; for example, high density polyethylene or DuPont Tyvek™, white-colored for high reflectance, such material providing a high emissivity coefficient, a low absorptivity coefficient, a strong puncture resistant exterior surface for shipment, a quality surface for printing, and a low air diffusion rate through the material.

The packaging of the invention provides effective thermal protection from the environment, particularly well suited for chilled or frozen samples, by protecting against: 1) conductive heating, through use of a fluid filler medium, preferably a gas such as air, carbon dioxide, or argon, or the like; 2) convective heating by using baffles that provide spacing smaller than the before-described Grashof criterion value; and 3) radiative heating, by using a material with a high emissivity coefficient and a low absorptivity coefficient, as previously stated.

Such baffles are readily manufactured, in accordance with preferred techniques of the invention, using a combined inking and thermal laminating process with a plurality of thin film sheets, formed, as described in my before-referenced co-pending applications in an in-line process for forming an inflatable valved envelope, lined with internal expandable baffles.

In using the invention, such envelope or package may be filled with a cold material, such as an ice-pack or dry-ice, a chilled item, as well as an absorbent material within the container, and after inflation, may be sealed closed, shipped, and then opened, deflated, and placed for recycling collection.

Preferred and best mode designs and forming techniques are hereafter described.

DRAWINGS

The invention will now be described in connection with the accompanying drawings in which:

FIG. 1 is a two-dimensional view illustrating a preferred flat tubular valve constructed in accordance with said co-pending application U.S. Pat. Ser. No. 278,610, assembled upon a lower thin film constituting an outer surface of the ultimate inflatable envelope chamber similar to that of said co-pending application U.S. Pat. Ser. No. 092,750;

Figure 4:
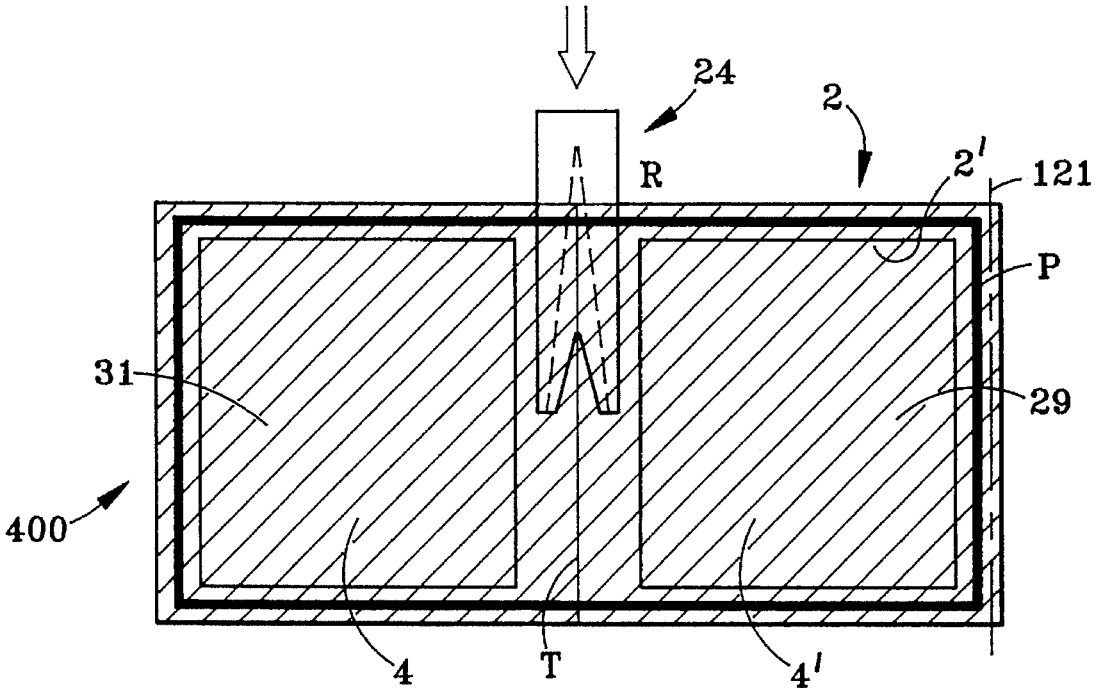
FIG. 4 is a view showing the peripheral seals and ultimate formation of the adjacent envelope chambers in accordance with the present invention.
Figure 7:
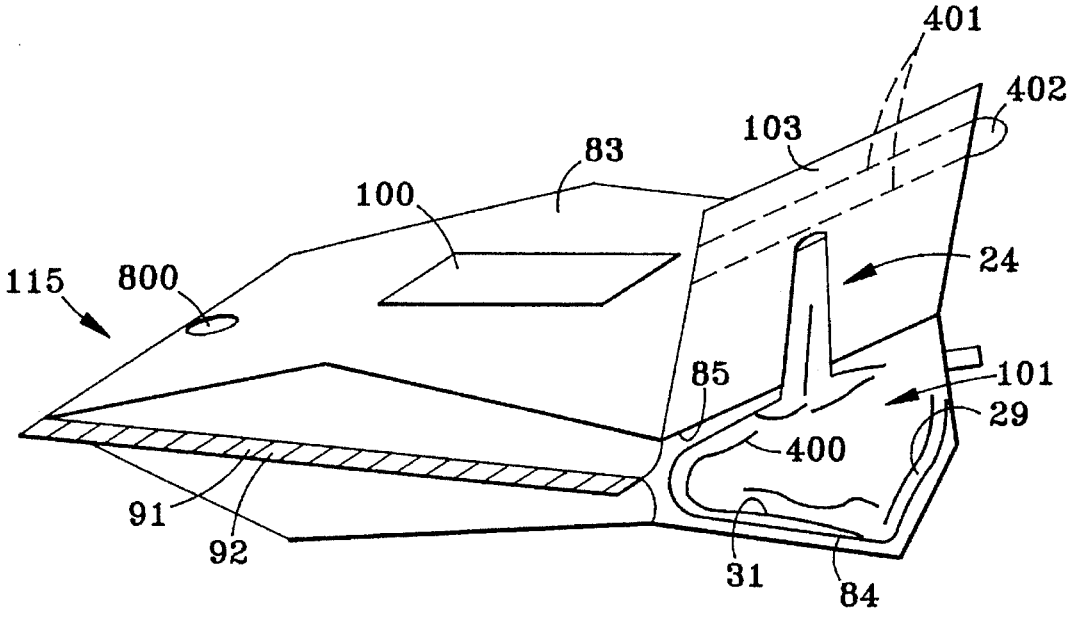

FIGS. *6a* and *6b* are isometric views of the formed adjacent envelope chambers of FIG. 4 integrated with a box and an external or outer shipping envelope or bag, respectively;

FIG. 7 is an isometric view showing the integrating of the formed adjacent envelope chambers of FIG. 4 with an external shipping envelope or bag as described in FIG. *6b;*

Figure 8:
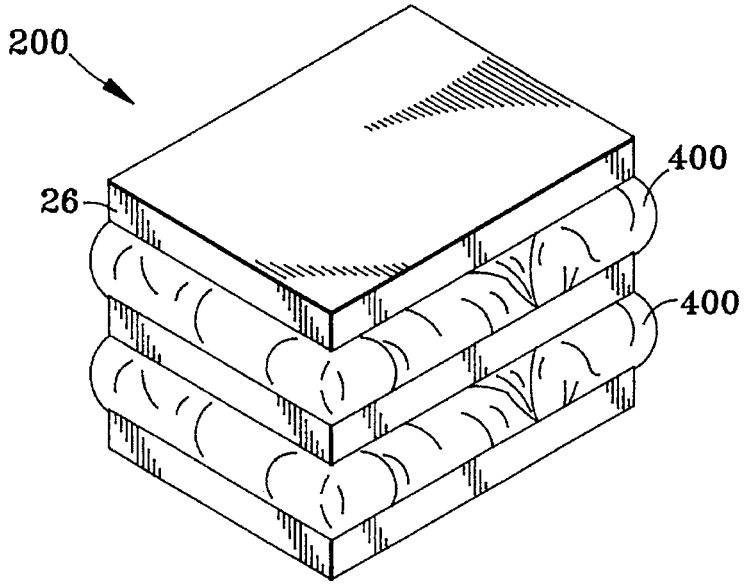
Figure 9:
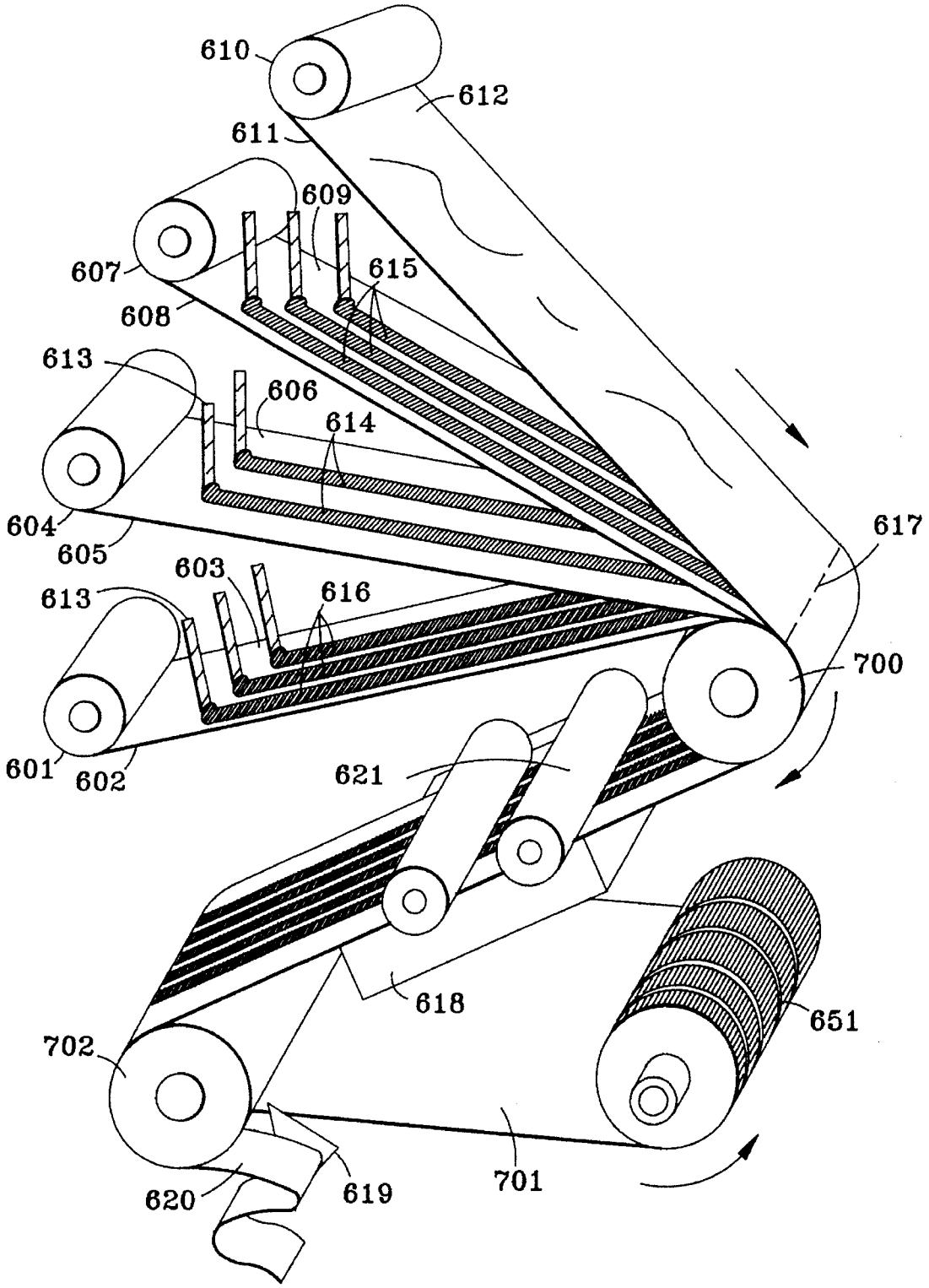
Figure 10:
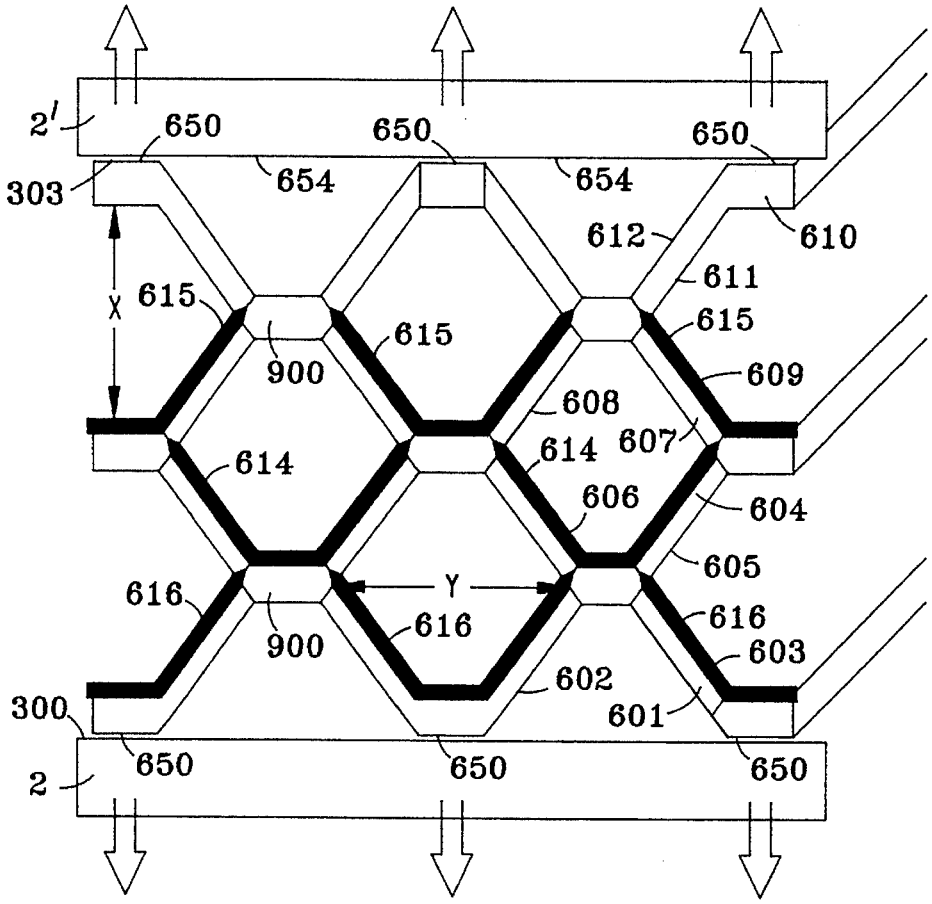
Figure 11:
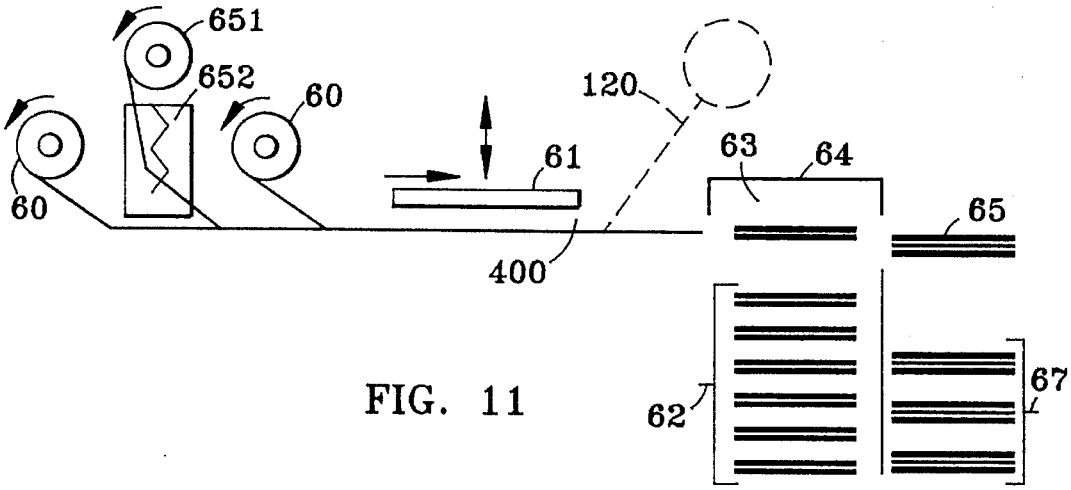

FIG. 8 presents isometric views illustrating means for providing thermal insulation, using the formed adjacent envelope chambers of FIG. 4, between walls and/or other items;

FIG. 9 is an isometric view illustrating an in-line manufacturing process for making the preferred form of baffles of the invention;

FIG. 10 is an isometric view illustrating the expanded or open position of the baffles formed in FIG. 9; and FIG. 11 is a block diagram illustrating a preferred means of making the packaging system of FIG. 4 and forming this into the envelope form of FIG. 7.

DESCRIPTION OF PREFERRED EMBODIMENT(S)

Figure 1:
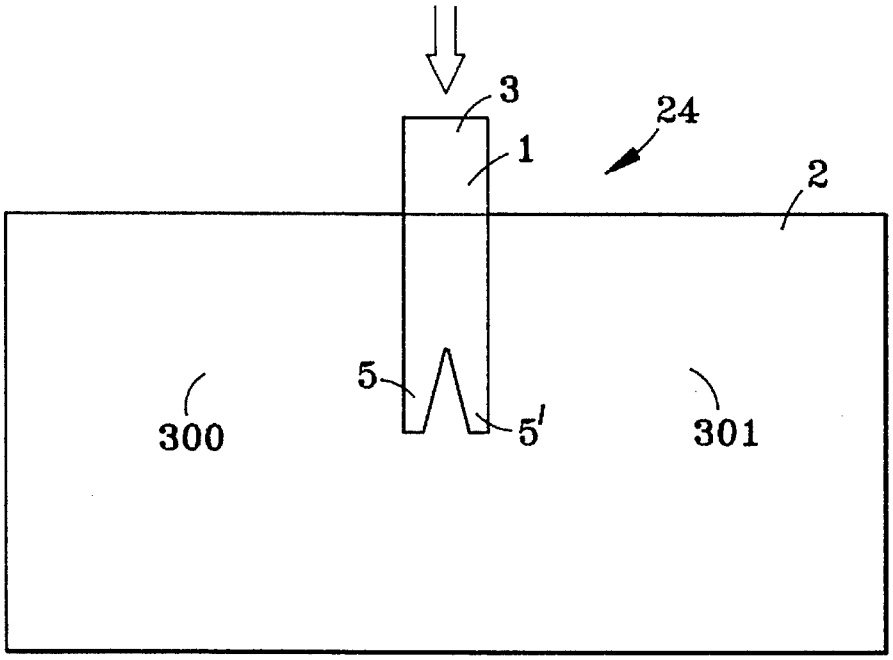

Referring to FIG. 1, a thin film layer is shown at 2, as of plastic film such as high density polyethylene or the like which is to serve as one side (shown as the lower) of the ultimate inflatable envelope chamber structure. In accordance with my previously referenced co-pending applications U.S. Pat. Ser. Nos. 278,610 and 092,750, valve 24 is formed from a thin film flat collapsed tubular rectangular strip 1, as of polyethylene, open at an inlet end 3 and which is to extend outside the ultimate envelope for inflation purposes. Interior space within the flat tubular strip is adapted thus to inflate as the fluid, such as air, is introduced into the inlet end 3 as shown in the dotted lines in FIG. 4, inflating the inner tube space and passing out the outlet ends 5 and 5', extending inwardly by the edge of the layer 2 at an intermediate region thereof.

Figure 2:
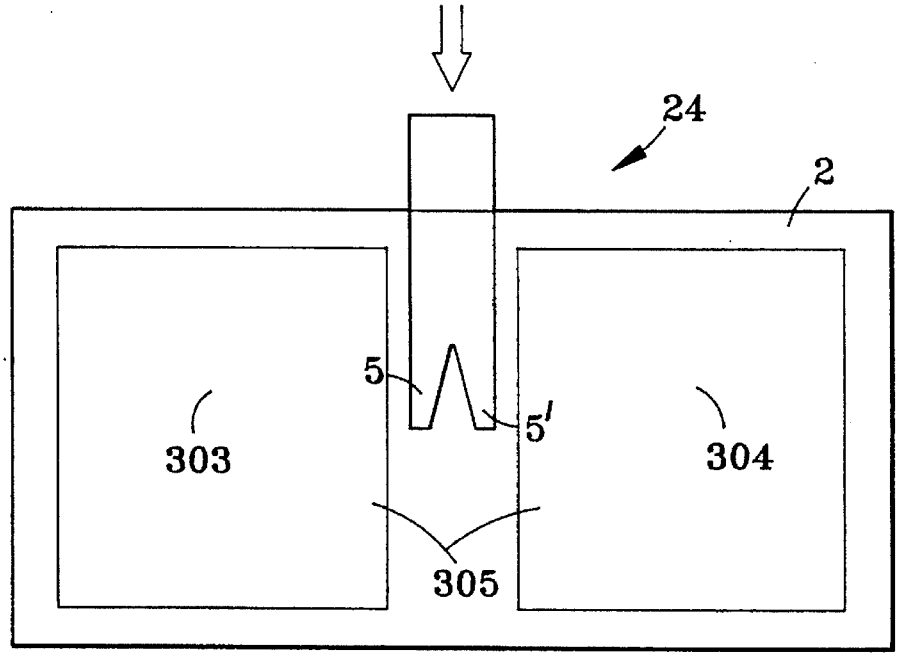
FIG. 2 is a view similar to FIG. 1 showing the application, in accordance with the present invention, of baffle strips compressed or closed position upon the lower film construction.
Figure 3:
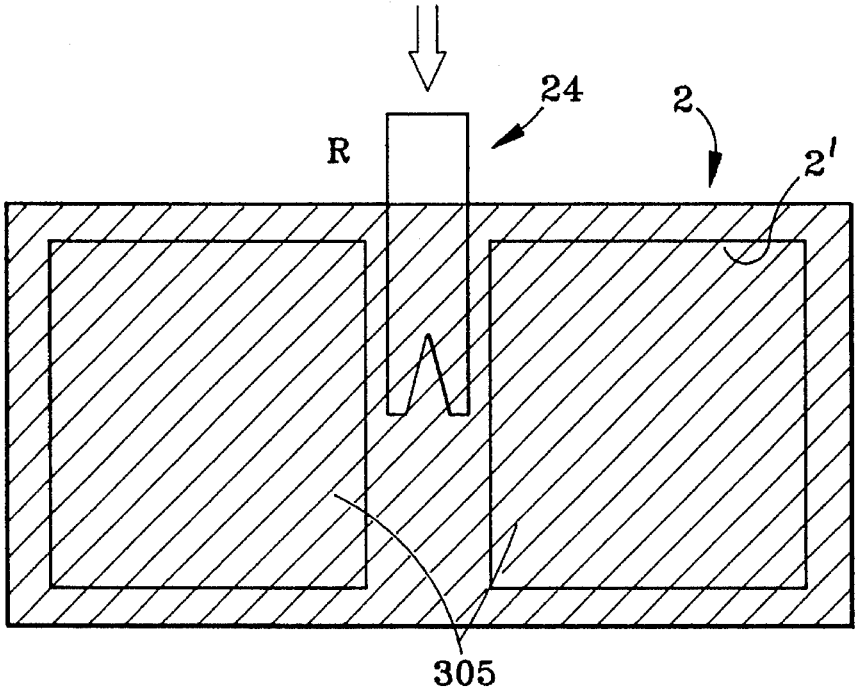
FIG. 3 is a similar view showing the application of the outer or upper thin film over the valve and the baffles of FIGS. 1 and 2.

In accordance with the invention, in FIG. 2, flat collapsed or closed baffles 305 for use as convective honeycomb or cellular type strip barriers, more fully described in connection with the embodiments of FIGS. 9 and 10, are located in regions 300 and 301 of film 2. To complete the formation of the inflatable envelope chamber, an upper or other opposing thin film layer 2' is shown in FIG. 3 overlying the bottom layer 2, and top surfaces 303 and 304 of baffles 305, and with the valve strip 1 inserted at an intermediate region R between the inner and outer thin films 2 and 2' and extending a predetermined distance therewithin.

The envelope chambers are now ready for sealing. In FIG. 4, the peripheral perimeter P of the overlaid thin films 2 and 2' is showed sealed, as by heat sealing. In the vicinity of the region R, however, the heat sealing only seals the inner adjacent edges of the inner and outer thin films 2 and 2' to the outer opposite surfaces of the thin tubular flat strip 1, without sealing the interior space of the tubular valve strip. Thus, there is complete integrity of seal for the overlaid thin films 2 and 2' and the valve 24. In addition, predetermined adjacent surfaces of baffles 305 and thin films 2 and 2' may be adhered simultaneously using heat sealing methods or with adhesive prior to overlaying film 2' on film 2.

Further in accordance with the invention, the envelope thus formed is divided into a pair of adjacent envelope chambers 4 and 4', FIG. 4, by a transverse heat seal T extending from the lower sealed periphery, transversely upward and into the V notch of the portion of the valve 24 sealed within the region R. The two independent adjacent envelope chambers 4 and 4', with respective top surfaces 31 and 29, share a common vertex along their adjacent inner edges, as described in said co-pending applications, being thus adaptable to receive and fold-over so as to protect, for example an item to-be-shipped. The transverse seal T also insures the independent and separate filling of the chambers 4 and 4' through the common inlet 3 of the valve 24 and through their respective outlets 5 and 5'.

Figure 5:
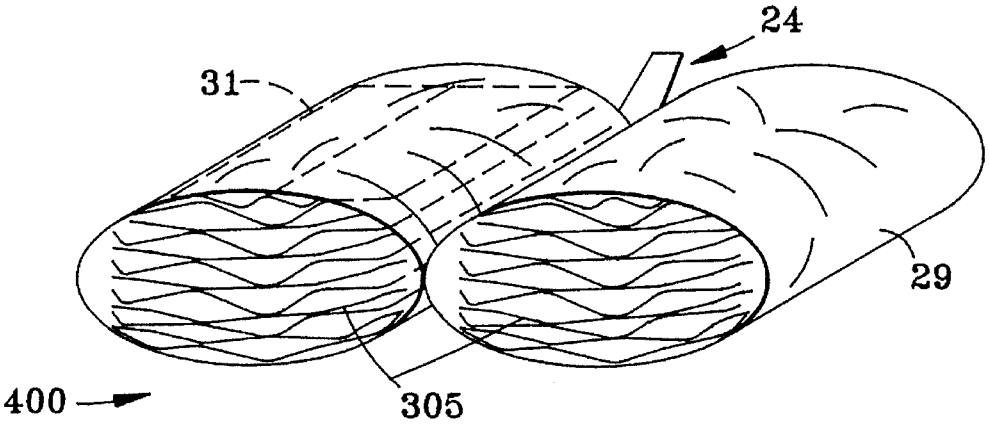
FIG. 5 is an isometric view of the formed adjacent envelope chamber bag of FIG. 4 inflated with a filler medium and further illustrating the cellular baffles in expanded or open position.

FIG. 5 illustrates the inflated adjacent envelope chambers 400 of FIG. 4. Upon inflation of chambers 400, the inner surfaces of films 2 and 2' separate by internal pressure, thus pulling flat honeycomb or cellular baffles apart from collapsed to expanded or open position from the adhered areas on surfaces 300, 301,303, and 304. The construction and design of these baffles, as before stated, is further discussed in connection with FIGS. 9 and 10.

Figure 6A:
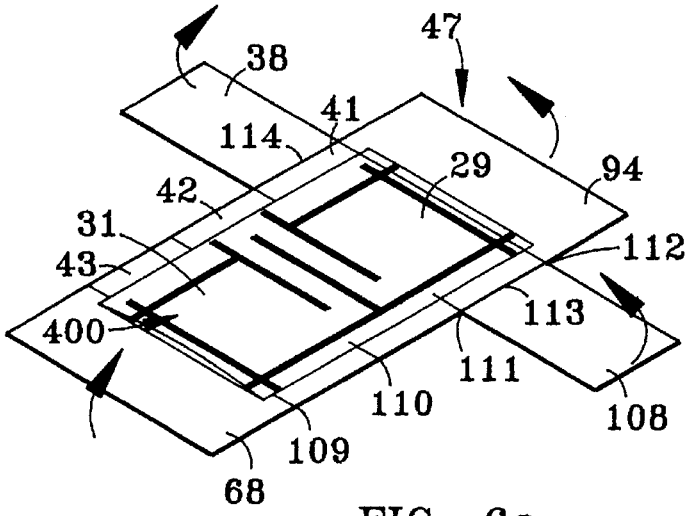
Figure 6B:
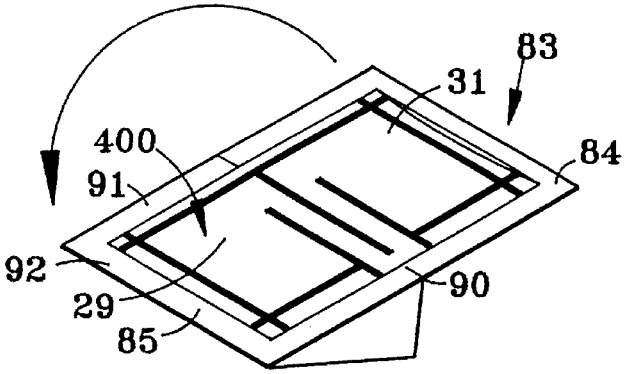

FIGS. 6*a* and 6*b* illustrate the integration of the inflatable chambers 400 with box blank 47 and an outer or external envelope 83 as described in said co-pending applications. Means for securing the chamber envelope 400 to the surface of the open box 47 and outer envelope 83 may be done using thermal sealing means or with transfer adhesive. Folding and sealing of the box 47 and envelope 83 as indicated by the arrows, is usually performed prior to inflation of the inner inflatable chamber envelope 400. The box can be formed by folding panels 68, 43, 42, 41, 38, and 108 along edges 109, 110, 111, 112, 113, and 114, respectively, and the box can be secured by adhesive between surfaces 68 and the underside of 94; the end portions of box 34 being secured by positioning surfaces 108 and 38 perpendicular to surface 41 and securing to the underside of surface 68. Envelope 83 may be formed by folding panels 84 and 85 along edge 90 and then sealing between edges 91 and 92. Outer envelope 83 is preferably made of the same material as the inflatable chambers 400 and baffles 305 so as to simplify recyclability of the product; as an example, the before-mentioned, Dupont Tyvek™, made of high density polyethylene, provides an excellent material which resists puncture and has limited stretch. In addition, outer envelope 83, if being used in a thermal insulating package application, in accordance with the present invention, should be made with such a material having a high emissivity coefficient and a low absorption coefficient (white color or metallized or the like) most effectively to resist thermal heating from the environment. The incorporation of the inner inflatable chambers 400 in the box and outer envelope blank can be automated as shown in FIG. 11.

FIG. 7 illustrates the packaging system of FIG. 6*b*, comprising the inflatable inner chamber liner 400 and the outer shipping envelope 83, wherein panels 84 and 85 have been sealed together, forming a closed envelope shown at 115. Generally, an article is placed between the chambers 29 and 31 of the inner inflatable liner 400 through opening 101. The chambers are then inflated through valve 24 as before explained. Opening 101 is further secured to the under-side of panel 85 using standard adhesive means, such as packaging tape or adhesive means, placed on surface 103. Inflation of the chambers 400 may also be performed after covering of opening 101 with surface 103. An address, warning, or shipping label or the like may be placed on the underside of surface 84 for shipping purposes as at 100. In addition, a hole, hook, or other non-permanent attaching means 800 may be located on package 115 to allow for storage of the package.

Upon receiving a shipped package 115, opening may be accomplished by pulling at tab 402 along perforations 401. Deflation through valve 24 may be done in accordance with said co-pending applications or by puncturing chambers 29 and 31 of the inflatable chambers 400. Upon removal of contents placed within outer envelope package 115, as for example a cold pack, an absorbent material, or other temperature-sensitive items, package 115 may be placed in a recycling bin for collection.

The overall package 115 provides an ideal package for shipping temperature-sensitive goods since the package provides effective blockage against each of conductive, convective, and radiative heat transfer from the environment, as well as cushioning properties for the item. As the shipped object remains suspended within the cushioning chamber pockets 29 and 31, filled with a filler medium, as for example air, such object may be insulated with several inches of highly resistive air pockets to block conductive heat flow. The convective currents inside pockets 29 and 31 are inhibited from forming by the expanded baffles whose mean distance between walls is less than the Grashof critical value. Insulation from radiant heat is further inhibited by choosing materials for making baffles 305, envelope 83 and thin film 2 and 2' that have a high emissivity coefficient and a low absorptivity value, such as the before-mentioned, white high density polyethylene. The overlaying of these materials, moreover, has an exponential effect on blocking the residual thermal radiation that is transmitted through each successive layer to the packaged item.

FIG. 8 illustrates application of the invention for use as a thermal barrier between heat flow through walls or stacked items 26 that are being shipped, or are temporarily or permanently affixed. In such applications, a temperature gradient across the chambers 400 forms as a result of its effective thermal resistance; or a combined impedance to conductive, convective, and radiative heat transfer is effected. Package 200 thus provides thermal insulation in a similar manner to the package 115. In addition, in accordance with said co-pending applications, package 200 may provide an effective damping coefficient for protecting items 26 from shocks experienced during shipment.

FIG. 9 illustrates a preferred method for manufacturing cellular connected baffles 305 in an in-line process. Such process begins by selecting the material to use for creating the baffle strips and the design of the baffles, further explained in conjunction with the description of FIG. 10. In FIG. 9, a four-layer baffle structure is manufactured using 4 sheets of thin film 610, 607, 604, and 601, as, for example, the previously referenced high density polyethylene. These sheets have respective upper and lower surfaces 612 and 611, 609 and 608, 606 and 605, 603 and 602. Creation of the baffle form is done by printing ink with rollers 613 on success top or lower surfaces of each film layer. Such rollers 613 are positioned at each layer so as to create linear patterns, when the film is passed under the roller, that are offset from the patterns created on prior and subsequent films. In FIG. 9, patterns 615 and 616 are offset from pattern 614; thus, overlaying the transparent films 607, 604, and 601 resembles one solid printed area, shown on roller 700, in which pattern 614 fills the transparent spaces of patterns 615 and 616.

In FIG. 9, furthermore, films 610, 607, 604, and 601, are brought together on roll 700 and further passed through heater 618 and heater rolls 621 which pass heat through the entire film and adhere the adjacent upper and lower surfaces of each of the film areas 900, FIG. 10, that do not have printing on them; thus forming the honeycomb-like or contiguous cellular baffle structure shown in FIG. 10. The combined baffle web 701, FIG. 9, is passed through roller 720 and further converted by slitting excess 620 with slitter 619. Web 701 is then collected on roll 651 and may be further segmented along direction 617 to create baffles 305. Roll 651 may also be incorporated in the in-line manufacturing system of FIG. 11.

FIG. 10 illustrates a cross section along direction 617 of the expanded web 701 and shows how such baffles may be positioned between thin film layers 2 and 2' at surfaces 300 and 303. Adhesion of the baffle external surfaces 612 and 602 to 2 and 2' at points 650 may be accomplished by placement of adhesive at these points, or by using a thermal heat sealing process; such process perhaps employing inking at points 654. The arrows in FIG. 10 also illustrate the force due to internal pressure that pulls the baffles apart. In designing the baffle, dimensions X and Y must be below Grashof's criterion for the specified package so as to inhibit any convective heat transfer through the package.

The X dimension in FIG. 10 is primarily determined by changing the number of baffles for the height of a filled chamber 29 or 31, FIG. 4, with the height of the chambers being in turn designed so as to provide effective cushioning characteristics for the shipped item. Therefore, for a given chamber height H, and baffle layers N, $$\text{Grashof's Criterion} > X = \frac{H}{N+1} \qquad \text{Eq. 5}$$

Solving for N yields:

$$N > \frac{H}{\text{Grashof's Criterion}} - 1 \qquad \text{Eq. 6}$$

The Y dimension in FIG. 10 is primarily affected by the width of each of the ink marks made by 613 in patterns 616 or 615 or 614. For a given sized chamber 29 or 31, FIG. 4, a baffle top face area 303 or 304, FIG. 2, should be designed to fit as closely to the perimeter seal P and transverse seal T, in FIG. 4, without touching either. Upon selection of a given baffle width (in the case of FIG. 4 the width of the baffle is perpendicular to T), the maximum length Y, FIG. 10, can be approximated by:

$$Y < \textit{Grashof's Criterion} \qquad \text{Eq. 7}$$

Therefore, the minimum number or parallel equidistant ink lines K (or non-contacting lines) on each layer of a baffle width W is given by the following:

$$K > \frac{W}{\text{Grashof's Criterion}} - 1 \qquad \text{Eq. 8}$$

Such ink lines must also be positioned so that the in-between non-inked areas on a given film are all of a predetermined substantially equal width. In cases where H>y(N+1), moreover, N should be increased until H<y(N+1) so as to avoid tearing the baffle structure at sealed areas 900, FIG. 10.

FIG. 11 illustrates a preferred manufacturing assembly line for combining the modified flat bag 400 of the invention and a box 47 or envelope 83 in a single unit as proposed in said co-pending applications. The unmodified material of the upper and lower planar surfaces 2 and 2' is rolled on a single or several spools 60 and fed along a predetermined path m the right. Spool 651 of baffling is fed through slitter 652, which cuts baffles along path 617, FIG. 9, and further places the baffles in predetermined positions between layers 2 and 2' as well as a valve 24. It is formed into the adjacent chamber bag of FIG. 4 via a stamping die 61. This die may use thermal means for sealing as well as adhesive means. One or more boxes 63 from shelving area 62 are partially opened and inserted into each using assembly machine 64. Assembly mechanism 64 as well as die 61 may also be used to cut the successive flat bags 400 from the rolls 60. The combined modified flat bag 400 and the box 47, or envelope 83, are subsequently stacked or shelved as a single unit 65 in shelving area 67. Where box insertion is not desired, a roll (s) of successive pairs of adjacent flat bags 400 may be provided, FIG. 4, each with its intermediate inflation channel 24, as schematically illustrated by the dotted lines 120 in FIG. 11, after and above the die 61. A the same time, perforations or scoring lines 121, FIG. 4, between successive pairs of bag chambers may be introduced at the die 61 so that a user may tear successive fiat double bag chambers from the roll.

As before stated, the high emissivity of the chamber walls and of the outer envelope or bag, where used, may also be achieved by using thin layer plastic film externally metallized.

Further modifications will also occur to those skilled in this art and such are considered to fall within the spirit and scope of the invention as defined in the appended claims.

What is claimed is:

1. A package for retaining cold articles having, in combination, a pair of adjacent cushioning envelopes inflatable through an externally extending valve; and collapsed planar honeycomb strips internally adhered within one of the inflatable cushioning envelopes and inflatable with the envelopes to form open cellular baffles between the inner walls of the cushioning chambers that prevent heat convection therein and minimize heat conduction there between; the pair of inflatable envelopes receiving and cushioning a cold article there between.

2. A package as claimed in claim 1 and including said honeycomb strips internally adhered within both of said cushioning envelopes.

3. A package as claimed in claim 1 and in which the envelopes are contained within an outer shipping envelope.

4. A package as claimed in claim 1 and in which the cushioning envelopes and/or the baffle strips are formed of thin film plastic layers of sufficiently high emissivity and low absorptivity coefficients to resist heat transfer.

5. A package as claimed in claim 4 and in which the plastic is selected from the group consisting of polyethylene, white high density polyethylene, and thin metallized films.

6. A package as claimed in claim 3 and in which at least one of the outer shipping envelope, the inner cushioning envelopes and the baffle strips is formed of thin layers of high emissivity and low absorptivity coefficients.

7. A method of retaining the temperature of an article during storage or shipping, that comprises, receiving the article between a pair of inflatable adjacent flexible cushioning envelopes, and providing within and between the inner walls of one or both of the envelopes collapsed flat strip cellular baffles secured to the inner walls and adapted to be pulled into open expanded position by the inner walls during envelope inflation.

8. A method as claimed in claim 7 and in which the envelopes are formed of thin layer material of sufficiently high emissivity and low absorptivity coefficients to resist heat transfer.

9. A method as claimed in claim 8 and in which the cushioning envelopes are contained within an outer envelope.

10. A method as claimed in claim 9 and in which the outer envelope is of similar material to that of the inner cushioning envelopes.

11. A method as claimed in claim 8 and in which the article is a cold article and the cushioning envelopes and baffles thermally insulate the article against heat convection, conduction, and radiation losses.

12. A method as claimed in claim 7 and in which the cushioning envelopes are inflated to provide at least several inches of inflated pockets to provide high resistance to conductive heat flow, and the baffle cross dimensions are selected to have at least the minimum spacing of the order of a half of a centimeter for preventing convective heat transfer.

13. A method of retaining the temperature of an article during storage or shipping, that comprises, receiving the article between a pair of inflatable adjacent flexible cushioning envelopes, and providing within and between the inner walls of one or both of the envelopes inflatably opening contiguous cellular baffles secured thereto, and in which the baffles are formed by printing the surfaces of a plurality of plastic film layers with the baffles strip configurations, and then in-line heat-laminating the layers to adhere the imprinted areas of the layers.

* * * * *